US005259618A

United States Patent [19]

Ramos

[11] Patent Number: 5,259,618

[45] Date of Patent: Nov. 9, 1993

[54] SECURITY DICE CUP

[76] Inventor: Ron Ramos, 6363 Christie Ave., Suite 727, Emeryville, Calif. 94608

[21] Appl. No.: 930,756

[22] Filed: Aug. 14, 1992

[51] Int. Cl.[5] ..... A63F 9/04; B65D 41/04

[52] U.S. Cl. ..... 273/145 C; 273/144 B; 215/330

[58] Field of Search ..... 273/145 C, 145 CA, 145 R, 273/144 B; 215/330, 329, 207, 215

[56] References Cited

U.S. PATENT DOCUMENTS

| | | | |
|---|---|---|---|
| 148,374 | 3/1874 | Mains | 273/145 C |
| 1,781,983 | 11/1930 | Koch | 273/145 C |
| 2,225,519 | 12/1940 | Dauda | 273/145 C |
| 2,746,757 | 5/1956 | Frost | 273/145 C |
| 3,892,410 | 7/1975 | Hoetzel | 273/145 C |
| 4,533,143 | 8/1985 | Albright et al. | 273/145 C |
| 4,692,119 | 9/1987 | Ussery | 273/156 |

*Primary Examiner*—Benjamin H. Layno
*Attorney, Agent, or Firm*—Flehr, Hohbach, Test, Albritton & Herbert

[57] ABSTRACT

A lockable dice cup for use in games of chance. The dice cup is comprised of a transparent cylindrical wall which attaches a receiver base to form a chamber for containing the dice. A locking mechanism is provided and comprises a tamperproof set screw having an end which lockably engages the cylindrical wall to capture the dice within the chamber and thereby prevent unauthorized dismounting of the wall from the receiver base.

11 Claims, 1 Drawing Sheet

SECURITY DICE CUP

TECHNICAL FIELD OF THE INVENTION

The invention relates to a security dice cup for use in playing games of chance wherein a plurality of dice are shaken in a lockable container.

BACKGROUND OF THE INVENTION

In playing games of chance, it is traditional for an individual player or dealer to "throw" two or more dice in order to obtain a score based on the value of the upper faces of the dice when they come to rest. If the game is to be truly a "game of chance", it is required that the dice fall in a random manner, uninfluenced by the thrower's technique in rolling or tossing the dice.

To minimize any effects of the individual's throwing technique, a dice cup may be used instead of bare hands to shake or roll the dice.

U.S. Pat. No. 2,225,519 is directed to a shaker box with a base designed to trap and display the dice as they have randomly fallen.

Another type of dice cup makes use of a transparent wall which forms a chamber to contain the dice upon a flat receiver. The player shakes the dice within the cup, and then sets it upon a table so that the receiver rests upon the table. As the cup is set upon the table, the dice fall upon the receiver and come to rest in a chance-controlled arrangement. The score of the dice may be read through the transparent wall of the chamber. Dice cups with transparent walls are described in U.S. Pat. Nos.: 148,374; 1,781,983; and 3,892,410.

To further minimize the possibility of the thrower influencing the outcome, a cup with a transparent wall may be enclosed within a non-transparent cover prior to the throw. After the cup is resting on the table, the cover is removed without disturbing the arrangement of the dice, and the score is read through the transparent wall.

The dice must be equally weighted on all sides in order to assure that the outcome of the throw is truly random. A dishonest player or dealer might substitute weighted dice in order to predict which sides will face upwards most often, and thus predict the resulting score. Dice might also be made with asymmetrically placed metal inclusions, which would allow an unscrupulous player or dealer to control the fall of the dice through surreptitious use of a magnet.

Because of the potential for substitutions of non-standard dice, gaming establishments such as card rooms prefer to use a dice cup which contains the dice more securely than the above described cups. Currently in use are cups with threaded lower walls which screw on to a threaded receiver. This makes it more difficult for a player or dealer to substitute dice during a game because the manipulations involved in opening the cup would be noticed by the other players. However, before or between games there still exists the potential for surreptitious dice substitutions by anyone with access to the loaded dice cup.

What is needed is a dice cup that can be locked with the dice in place. This would allow the gaming establishment to control access to the interior of the cup and therefore prevent dice substitutions. Moreover, an authorized person with a key could open the cup to inspect the dice and replace them with authorized dice, if needed.

SUMMARY AND OBJECTS OF THE INVENTION

The invention is a lockable dice cup, which is an improvement on existing dice cups, and represents a combination of a dice cup with a transparent wall and a locking means.

The object of the invention is to provide a dice cup for playing a game of chance, said dice cup providing the assurance that the interior of the dice cup and the identity of the dice contained therein are reasonably controlled by authorized employees of a gaming establishment.

DETAILED DESCRIPTION OF THE INVENTION

The invention is a lockable dice cup for use in games of chance comprising the combination of a transparent dice holder mounted onto a receiver to form a chamber for containing and rolling dice, and a locking mechanism comprising a tamperproof screw mounted within a bore in the receiver to secure the holder to the receiver.

Figure 1:
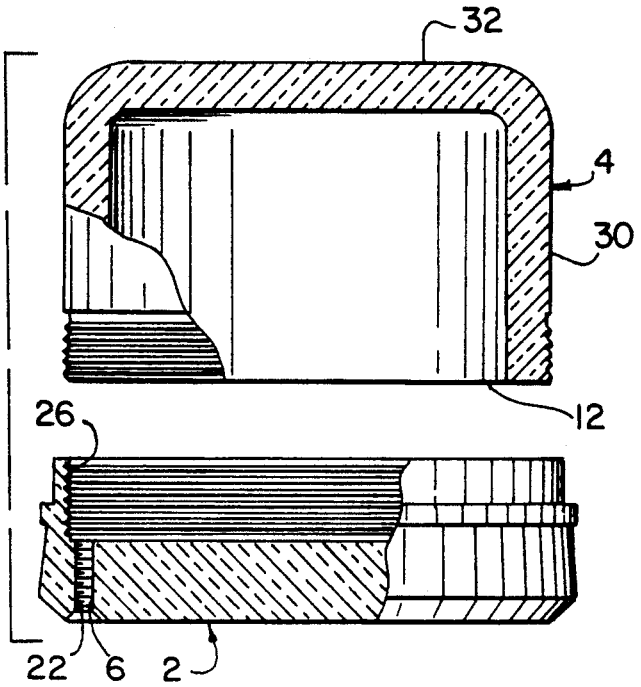
FIG. 1 is an exploded view in longitudinal cross-section of a security dice cup according to the invention.
Figure 2:
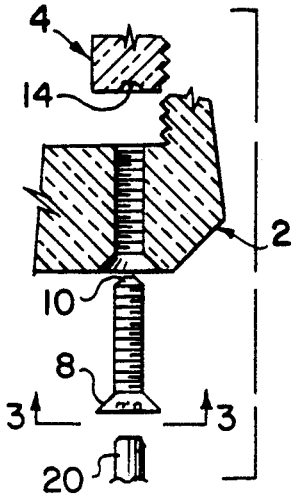
FIG. 2 is a fragmentary cross-sectional view, to an enlarged scale, of component elements of the dice cup of FIG. 1.
Figure 3:
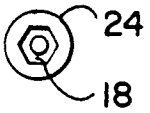
FIG. 3 is a sectional view taken along the line 3—3 of FIG. 2.
Figure 5:
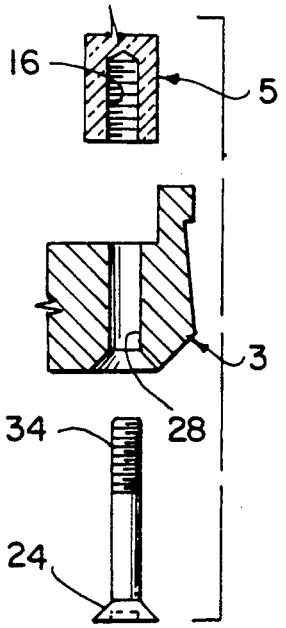
FIG. 5 is a fragmentary exploded view in longitudinal section of components of the dice cup of FIG. 4.

FIG. 1 depicts one preferred embodiment of the invention. The dice holder 4 has a wall with an open end 12 which is threaded to screw onto matching threads 26 on the receiver 2, thereby forming a chamber for containing and rolling dice. The receiver has a threaded bore 22 into which a tamperproof set screw 8 is mounted by means of a non-standard key 20. When the set screw is in place, its distal end prevents unscrewing of the holder from the receiver by means of either a force fit or by means of fitting into a recess 14 in the wall of the holder. In this embodiment, the dice cup is necessarily cylindrical since the locking means is dependent on the holder being screwed onto the receiver.

Figure 4:
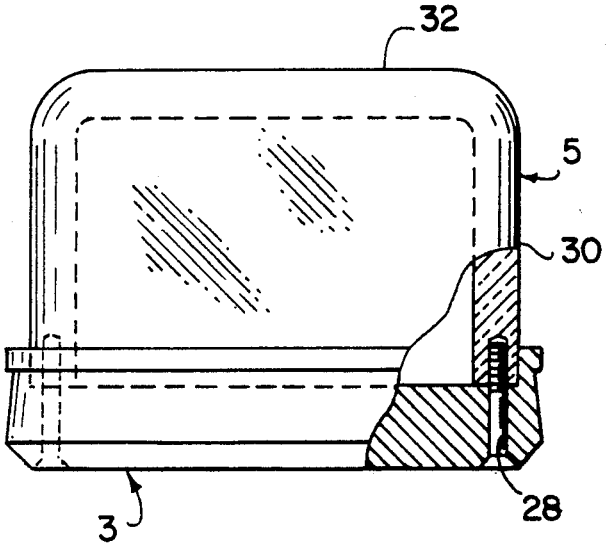
FIG. 4 is a side elevational view of a security dice cup according to another embodiment of the invention.

FIG. 4 depicts a second preferred embodiment of the invention. In this embodiment, the wall 30 of the holder does not screw onto the receiver, but rather rests on the perimeter of the receiver. Locking is accomplished by means of a tamperproof screw 24 which is inserted through a bore in the receiver and then screwed into a threaded bore 16 in the wall 30 of the holder 5. In this embodiment, it is not necessary for the dice cup to be cylindrical because the locking mechanism is not dependent on the holder and receiver being screwed together.

The holder 5 is made of a substantially transparent material, preferably plexiglass or acrylic, to allow the position of the dice to be observed once the throw has been made. Herein, the term "substantially transparent" refers to any material which allows observation of the position of the dice. Preferably, the entire holder may be made of clear acrylic. Alternatively, the top 32 of the holder may be made of clear acrylic while the wall 30 may be made of an opaque material such as colored acrylic, resin/plastic, or metal. The holder may also be made of glass, however a more durable material such as acrylic is preferred. The receiver 3 is made preferably of aluminum or polycarbonate. One of skill in the art of machining metals and plastics will be able to ascertain other suitable materials for use in making the components of the dice cup.

In the embodiment of the invention depicted in FIG. 1, the tamperproof screw may be a set screw 8 which locks the holder to the receiver by means of its distal end forming a force fit or by fitting into a recess 14 in the open end of the wall 12 of the holder 4. Various types of set screws having different types of distal ends are shown in *Fundamentals of Engineering Drawing*, W. J. Luzadder, 8th ed., Prentice-Hall, 1981. Examples of types of distal ends are: cone point, flat point, cup point, full dog point, and half-dog point. Set screws having either a flat point, a full dog point, or a half dog point may lockably engage the holder to the receiver by means of a force fit. Alternatively, set screws having a cone point or a cup point may lockably engage the holder to the receiver by means of fitting into an appropriately shaped recess 14 in the open end 12 of the wall of the holder 4.

In the embodiment of the invention depicted in FIG. 4, the tamperproof screw is preferably a capscrew 24 having threading on at least its distal end 34. The capscrew lockably engages the holder to the receiver by being inserted through a bore in the receiver 28 and then being screwed into a threaded bore 16 in the open end of the wall 30 of the holder 5. In this embodiment, the bore 28 in the receiver does not need to be threaded as long as it's diameter is large enough to accommodate the diameter of the screw.

In either of the preferred embodiments, the head of the screw may be of any type which is tamperproof. Herein, the term "tamperproof" refers to a screw head which may only be turned by means of a non-standard key. In FIG. 1, the screw head 8 has a hexagonal socket 18 with a vertical post 24 in its center. Preferably, when the screw is fully advanced into the threaded bore 6, 16 in the receiver or the holder wall, respectively, the head fits into a recess 22 in the receiver so that the head of the screw is flush with the bottom surface of the receiver. This type of head may only be turned by means of a non-standard Allen wrench 20 which has a slot into which fits the vertical post of the screw head. One of skill in the art of the invention will be able to ascertain other types of tamperproof screws which will be useful in the locking mechanism of the invention. For instance, other types of non-standard socket shaped screw heads such as a five-sided polygon or a fluted head may be used in conjunction with an appropriately shaped key.

It is preferred but not required that at least two screws be used for each dice cup.

It is preferred but not required that, when fully advanced, the screw head fits within a recess to be flush with the bottom of the receiver. This allows the receiver to form a stable base upon which the dice cup rests to display the score of the rolled dice. Alternatively, the fully advanced screw heads may protrude beyond the bottom of the receiver as long as the screw heads are placed so that they balance the dice cup, and as long as the screw heads remain tamperproof in this position. For instance, round-headed screws may be used as long as at least three screws are evenly spaced around the bottom of the receiver, and as long as they can only be turned by means of a special key.

This invention may be used in conjunction with an opaque cover which is applied to the dice cup prior to the rolling of the dice to prevent the player from influencing the outcome of the score. After the dice are shaken or rolled, the covered dice cup is placed on a table, resting on its receiver, and the opaque cover is removed to allow a view of the upper faces of the dice to calculate the score.

The lockable dice cup of this invention is particularly useful in playing games of chance such as pai gow. The game of pai gow originated in ancient China and is played with domino-like tiles. The game of pai gow poker is based on the ancient game but uses conventional Western playing cards instead of tiles. In both forms of pai gow, three dice are rolled at several points in the game. Since the dice score is strategically important for a given player, there is elaborate ritual involved in the shaking of the dice and the observation of the score (House Rules, Oaks Club Cardroom, Emeryville, Calif. pp. 26–33). This ritual evolved to minimize cheating in the dice roll. However, when unauthorized persons have access to the interior of the dice cup, there is the potential for substitution of non-standard dice for house dice so that the dice score may be predicted or manipulated. The dice cup of the instant invention provides reasonable assurance that only persons authorized by the gaming establishment will have access to the special key required to open the dice cup. Thus, the dice cup of the invention may be opened only by authorized persons for inspection of the dice or replacement of worn dice.

What is claimed is:

1. A lockable dice cup for use in games of chance, comprising the combination of a receiver, said receiver being circular, a substantially transparent dice holder having wall means for defining a chamber for containing and rolling dice, said wall means being circular in cross section and having an open end which is threadably mounted onto said receiver, means for mounting the holder onto the receiver, means forming a threaded bore through the receiver with an end of the bore opening toward said wall means, and a tamperproof screw threadably mounted within said bore, said screw having a distal end which lockably engages said wall to capture the dice within the chamber and to prevent unauthorized dismounting of said holder from the receiver.

2. The dice cup of claim 1 wherein the distal end of said screw lockably engages said wall means by a force fit against an open end of said wall means, said force fit frictionally engaging said wall means to prevent relative turning between said holder and said receiver.

3. The dice cup of claim 1 wherein said wall means is formed with a recess which opens toward the base, the distal end of said screw lockably engaging said wall means by fitting in said recess to prevent relative turning between said holder and said receiver.

4. The dice cup of claim 1 wherein said wall is formed with a threaded second bore which opens toward the first mentioned bore, and said screw threadably engages the second bore to prevent relative turning between said holder and said receiver.

5. The dice cup of claim 1 wherein said tamperproof screw has a head with a predetermined shape which interfits with a key having a cross-section shape which is non-standard.

6. The dice cup of claim 1 wherein said head shape comprises a keyway for receiving said key, said keyway being internally recessed in the head and having a cross-sectional shape which conforms with the key.

7. The dice cup of claim 6 wherein said head shape is of the socket type, and said socket has a predetermined shape.

8. The dice cup of claim 7, wherein said socket shape is polygonal or fluted.

9. The dice cup of claim 7 wherein said socket shape fits an Allen wrench having a non-standard cross-sectional shape.

10. The dice cup of claim 7 wherein said keyway has a vertical post in its center.

11. The dice cup of claim 5 wherein said screw head fits within a recess formed in the bottom of said receiver.

* * * * *